US010704815B2

(12) United States Patent
Lundberg et al.

(10) Patent No.: US 10,704,815 B2
(45) Date of Patent: Jul. 7, 2020

(54) FLOW CONTROL VALVE FOR INJECTING OIL INTO AN AIR CONDITIONING CIRCUIT

(71) Applicants: Bosch Automotive Service Solutions LLC, Warren, MI (US); Robert Bosch GmbH, Stuttgart (DE)

(72) Inventors: Dylan M. Lundberg, Lonsdale, MN (US); Mark W. McMasters, Owatonna, MN (US)

(73) Assignees: Bosch Automotive Service Solutions LLC, Warren, MI (US); Robert Bosch GmbH, Stuttgart (DE)

( * ) Notice: Subject to any disclaimer, the term of this patent is extended or adjusted under 35 U.S.C. 154(b) by 1055 days.

(21) Appl. No.: 14/697,705

(22) Filed: Apr. 28, 2015

(65) Prior Publication Data

US 2015/0308722 A1 Oct. 29, 2015

Related U.S. Application Data

(60) Provisional application No. 61/984,917, filed on Apr. 28, 2014.

(51) Int. Cl.
*F25B 45/00* (2006.01)

(52) U.S. Cl.
CPC ..... *F25B 45/00* (2013.01); *F25B 2345/0052* (2013.01)

(58) Field of Classification Search
CPC ..... F25B 2345/0052
USPC .. 137/613, 614.2, 538, 540, 543.17, 543.19, 137/543.23
See application file for complete search history.

(56) References Cited

U.S. PATENT DOCUMENTS 3,770,009 A * 11/1973 Miller ..... F16K 15/026 137/515.5
4,350,176 A * 9/1982 Lace ..... F16K 17/04 137/242
5,548,966 A * 8/1996 Tinsler ..... B60H 1/00585 62/149
6,138,462 A * 10/2000 Murray ..... B60H 1/00585 62/149
6,915,813 B2 * 7/2005 Kobes ..... F16K 3/265 137/220

* cited by examiner

*Primary Examiner* — Eric Keasel
*Assistant Examiner* — Paul J Gray
(74) *Attorney, Agent, or Firm* — Maginot, Moore & Beck LLP

(57) ABSTRACT

An air conditioning service system includes an oil receptacle configured to store an oil, a solenoid valve configured to selectively allow the oil to flow from the oil receptacle into an oil injection line, a coupling port in fluid communication with the oil receptacle through the oil injection line when the solenoid valve is in an open condition, and a flow control valve with an inlet and an outlet. The inlet is in fluid communication with the oil receptacle when the solenoid valve is in the open condition, and the outlet in fluid communication with the oil injection line when the solenoid valve is in the open condition. The flow control valve is configured such that, for a given pressure difference between the inlet and the outlet, the oil flows from through the flow control valve at a flow rate that is independent of a viscosity of the oil.

19 Claims, 7 Drawing Sheets

FLOW CONTROL VALVE FOR INJECTING OIL INTO AN AIR CONDITIONING CIRCUIT

CLAIM OF PRIORITY

This application claims the benefit of U.S. Provisional Patent Application No. 61/984,917, which was filed on Apr. 28, 2014 and is entitled "Flow Control Valve for Injecting Oil into an Air Conditioning System," the disclosure of which is incorporated by reference herein in its entirety.

TECHNICAL FIELD

This disclosure relates generally to refrigerant service systems, and more particularly to flow control valves for refrigerant service systems.

BACKGROUND

Air conditioning systems include a mechanical compressor that compresses refrigerant flowing through the air conditioning system. The compressor requires oil to function properly and efficiently. During normal operation of the air conditioning system, a portion of the compressor oil is entrained in the refrigerant and circulated through the air conditioning system. When the air conditioning system is serviced, the refrigerant, along with the oil entrained therein, is typically removed from the air conditioning system. Additionally, the air conditioning system may require replacement of parts within the circuit, which can also remove compressor oil within the replaced parts. As such, new compressor oil must be injected into the system to replace oil removed from the system during maintenance and service operations. For this reason, most air conditioning service ("ACS") machines include a circuit for injecting oil into the air conditioning circuit prior to recharging refrigerant into the air conditioning system.

Measuring the oil injected into the air conditioning system is important to ensure the proper quantity of compressor oil is in the air conditioning circuit. Excess or insufficient oil in the compressor reduces the overall operational efficiency of the air conditioning system. One commonly used method of measuring oil injected into the air conditioning system is visual identification. Some conventional ACS machines include a bottle of oil having graduated markings that indicate the amount of oil in the bottle. To measure the quantity of oil injected into the system, the user monitors the oil level in the bottle with reference to the graduated markings as the ACS machine injects the oil, and terminates the injection operation when the desired quantity of oil appears to have been injected. This method has the lowest cost, but relies entirely on the user to monitor the bottle and inject the correct amount. As a result, the visual identification method suffers from issues, including operator error and inaccuracy of the markings or in reading the markings that can cause deviation from the desired quantity of oil injected into the air conditioning system.

Some conventional ACS machines include a load cell associated with the oil bottle to measure the weight of the oil bottle. The system is configured with a controller that subtracts the weight of the bottle during the injection process from the initial weight of the bottle to determine the amount of oil injected. Once the controller determines that the desired quantity of oil has been injected into the system, the controller operates the oil injection valve to close. However, load cells are expensive and delicate, and, as a result, ACS machines having a load cell for the oil bottle are costly to manufacture and maintain, and may malfunction if handled incorrectly.

Other typical ACS machines estimate the quantity of oil injected into the air conditioning system based on the time the oil injection solenoid valve is open. The oil flow rate is assumed, and a length of time that the oil injection solenoid valve needs to be open in order to inject the desired quantity of oil is estimated from the assumed oil flow rate. For example, in some ACS machines, the oil flow rate is assumed to be 2 ml per second. A user inputs the amount of oil for the system to inject, for example 10 ml. The ACS controller then calculates the time the system should be open, which, in this example, is 5 seconds.

One issue with such an oil injection method is that the oil flow rate is not a constant. The flow rate varies depending on the oil viscosity and the temperature of the oil, which is typically approximately the ambient temperature of the ACS machine. Some ACS machines that include time-based oil injection also include a way for the user to input a correction factor to correct the injected quantity or the time the valve is open based on variations in the flow rate due to the current conditions. One problem with this is that the user may not have accurate information to determine the proper correction factor. Another issue is that the user may be required to perform baseline tests or calculations in order to determine the correction factor, and errors in these tests or calculations can result in an incorrect correction factor being input to the machine. As a result, the time injection method fails to provide adequate accuracy due to the required user intervention and system variables.

For all of the above reasons, it would be desirable to provide an ACS machine that improves the precision of the quantity of oil injected into an air conditioning system at a low cost. Additionally, it would be desirable to provide an ACS machine that accurately injects a desired quantity of oil into the air conditioning system with minimal user intervention.

SUMMARY

An air conditioning service system includes an oil receptacle configured to store an oil, a solenoid valve configured to selectively allow the oil to flow from the oil receptacle into an oil injection line, a coupling port in fluid communication with the oil receptacle through the oil injection line when the solenoid valve is in an open condition, and a flow control valve with an inlet and an outlet. The inlet is in fluid communication with the oil receptacle when the solenoid valve is in the open condition, and the outlet in fluid communication with the oil injection line when the solenoid valve is in the open condition. The flow control valve is configured such that, for a given pressure difference between the inlet and the outlet, the oil flows from through the flow control valve at a flow rate that is independent of a viscosity of the oil.

In another embodiment, the flow control valve further includes a plunger movably positioned within the chamber. The plunger has an inlet facing surface at a first end portion configured to be impinged by the oil and a second end portion opposite the first end portion configured to increasingly restrict flow of the oil through the outlet as the plunger moves toward the outlet. The flow control valve also includes a biasing member configured to bias the plunger in a direction toward the inlet. The biasing member and plunger are configured such that for the given pressure difference between the inlet and the outlet, the oil flows from through the flow control valve at the flow rate that is independent of the viscosity of the oil.

In some embodiments, the inlet facing surface is perpendicular to a flow axis of the oil entering the inlet.

In a further embodiment of the air conditioning service system, an outlet valve seat is associated with the outlet, and the second end portion of the plunger includes a second end portion valve portion complementary to the outlet valve seat.

In another embodiment, an inlet valve seat is associated with the inlet, and the first end portion of the plunger includes a first end portion valve portion complementary to the inlet valve seat. In a further embodiment, the first end portion valve portion extends about the inlet facing surface.

In one embodiment of the air conditioning service system, an inlet valve seat is associated with the inlet and the first end portion of the plunger includes a first end portion valve portion complementary to the inlet valve seat. The first end portion valve portion extends about the inlet facing surface.

In some embodiments, the inlet facing surface of the plunger is substantially planar and perpendicular to a flow axis of the oil entering the inlet.

In another embodiment, the inlet defines an inlet cross sectional area, the inlet facing surface defines an inlet facing surface area, and the inlet cross sectional area is substantially equal to the inlet facing surface area.

In some embodiments, the inlet facing surface of the plunger is concave.

In another embodiment of the disclosure, a flow control valve for use in an air conditioning service system, comprises a chamber with an inlet and an outlet, a plunger movably positioned within the chamber, the plunger having an inlet facing surface at a first end portion and a second end portion opposite the first end portion, and a biasing member configured to bias the plunger toward the inlet. The inlet facing surface, the second end portion, and the biasing member are configured such that a flow of air conditioning oil through the flow control valve remains constant over a range of viscosities of the air conditioning oil for a given differential pressure across the flow control valve.

In one embodiment of the flow control valve, the inlet facing surface is perpendicular to a flow axis of the air conditioning oil entering the inlet.

In another embodiment, the flow control valve further comprises an outlet valve seat associated with the outlet, and the second end portion includes a second end portion valve portion complementary to the outlet valve seat.

Another embodiment of the flow control valve further comprises an inlet valve seat associated with the inlet, wherein the first end portion includes a first end portion valve portion complementary to the inlet valve seat.

In some embodiments, the first end portion valve portion extends about the inlet facing surface.

In a further embodiment, the flow control valve includes an inlet valve seat associated with the inlet. The first end portion includes a first end portion valve portion complementary to the inlet valve seat, and the first end portion valve portion extends about the inlet facing surface.

In another embodiment of the flow control valve, the inlet facing surface is substantially planar and perpendicular to a flow axis of the oil entering the inlet.

In yet another embodiment of the flow control valve, the inlet defines an inlet cross sectional area, the inlet facing surface defines an inlet facing surface area, and the inlet cross sectional area is substantially equal to the inlet facing surface area.

In some embodiments of the flow control valve, the inlet facing surface is concave.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
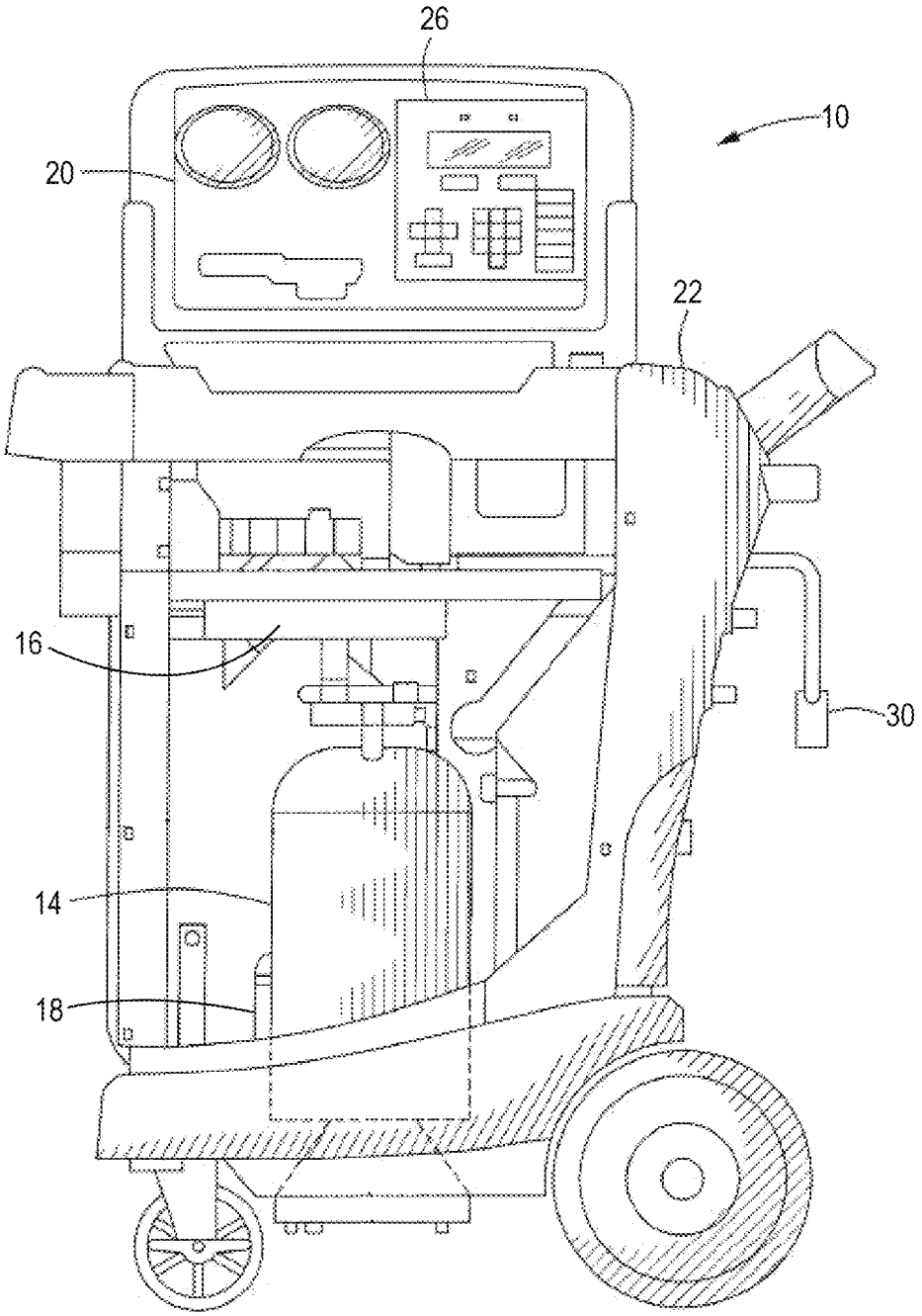
FIG. 1 is a partial cutaway front view of a refrigerant service system.

FIG. 1 is an illustration of an air conditioning service ("ACS") system 10 according to the disclosure. The ACS system 10 includes a refrigerant container or internal storage vessel ("ISV") 14, a manifold block 16, a compressor 18, a control module 20, and a housing 22. The exterior of the control module 20 includes an input/output unit 26 for input of control commands by a user and output of information to the user. Hose connections 30, 32 (only one is shown in FIG. 1), which are also referred to herein as coupling ports, protrude from the housing 22 to connect to service hoses that connect to an air conditioning ("A/C") system (also referred to herein as an "air conditioning circuit") and facilitate transfer of refrigerant between the ACS system 10 and the A/C system.

The ISV 14 is configured to store refrigerant for the ACS system 10. No limitations are placed on the kind of refrigerant that may be used in the ACS system 10. As such, the ISV 14 is configured to accommodate any refrigerant that is desired to be charged to the A/C system. In some embodiments, the ISV 14 is particularly configured to accommodate one or more refrigerants that are commonly used in the A/C systems of vehicles (e.g., cars, trucks, boats, planes, etc.), for example R-134a, $CO_2$, or R1234yf. In some embodiments, the ACS unit has multiple ISV tanks configured to store different refrigerants.

The manifold block 16 is fluidly connected to the ISV 14, the compressor 18, and the hose connections 30, 32 through a series of valves, hoses, and tubes. The manifold block 16 includes valves and components configured to filter and purify refrigerant recovered from a vehicle during a refrigerant recovery operation prior to the refrigerant being stored in the ISV 14, and to recharge the refrigerant back into the air conditioning circuit from the ISV 14.

Figure 2:
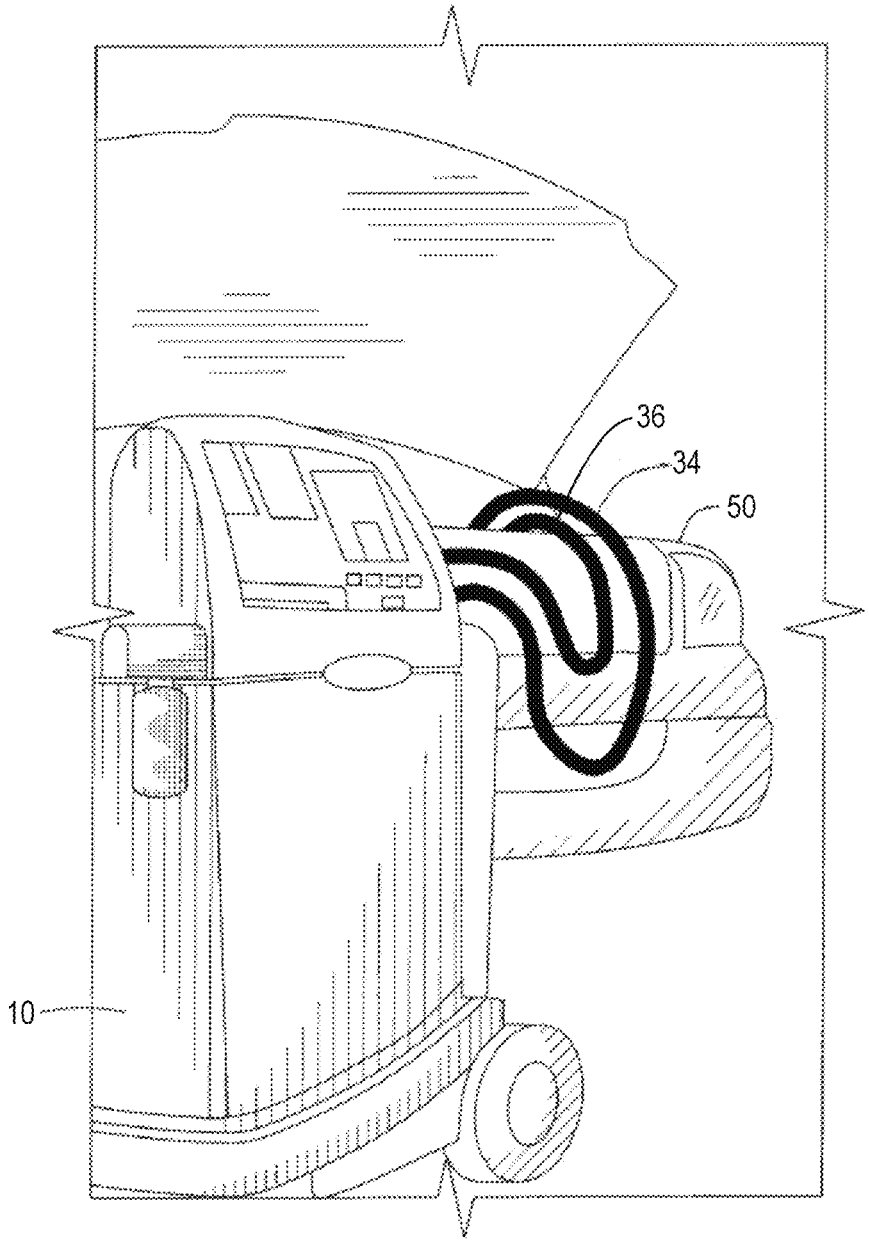
FIG. 2 is side perspective view of the refrigerant service system of FIG. 1 connected to a vehicle.

FIG. 2 is an illustration of a portion of the ACS system 10 illustrated in FIG. 1 connected to a vehicle 50. Service hoses 34, 36 include coupling connectors 38, 40 (FIG. 3) configured to connect an inlet and/or outlet port of the air conditioning circuit of the vehicle 50 to the hose connections 30 (shown in FIGS. 1 and 3) of the ACS unit 10.

Figure 3:
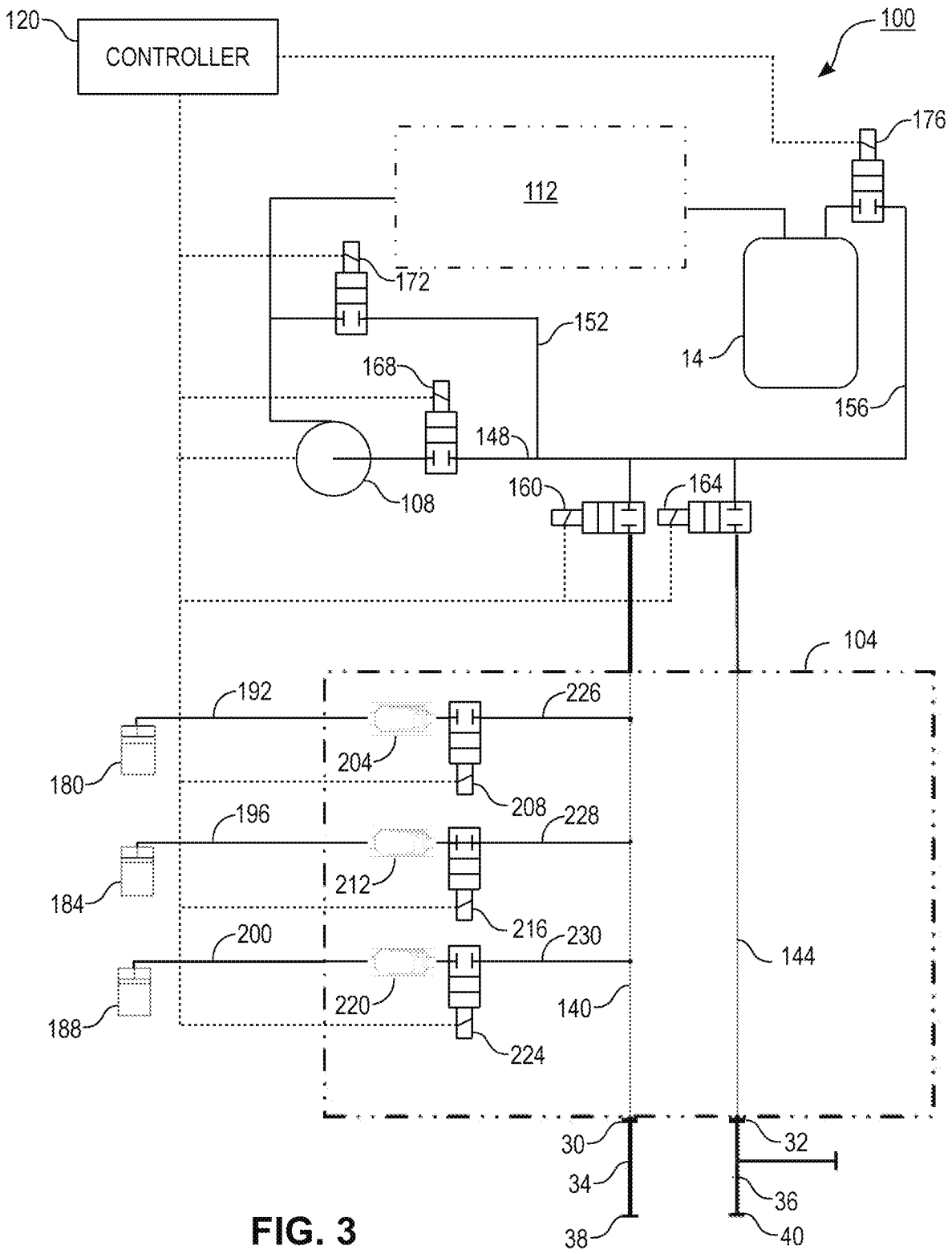
FIG. 3 is a schematic view of the refrigerant service system of FIG. 1.

FIG. 3 illustrates a schematic diagram of the ACS system 10. The ACS system 10 includes a bulkhead manifold 104, a vacuum pump 108, a recovery manifold 112, the ISV 14, and a controller 120, which, in one embodiment, is integrated with the control module 20. In some embodiments, one or both of the bulkhead manifold 104 and the recovery manifold 112 are at least partially integrated within the manifold block 16, while in other embodiments the bulkhead manifold 104 and the recovery manifold are separate from the manifold block 16.

The high-side service hose 34 and the low-side service hose 36 connect to the coupling ports 30, 32 of the bulkhead manifold 104 at one end, and the hose couplers 38, 40 at the other end of the service hoses 34, 36 are configured to attach to the high-side and low-side, respectively, of the air conditioning circuit of the vehicle 50. The bulkhead manifold 104 includes a high-side line 140 and a low-side line 144 fluidly connecting the coupling ports 30, 32, respectively, to a vacuum line 148, a recovery line 152, and an ISV charge line 156 through a high-side solenoid valve 160 and a low-side solenoid valve 164, respectively.

The vacuum pump 108 and a vacuum solenoid valve 168 are disposed in the vacuum line 148. A recovery solenoid valve 172 is located in the recovery line 152, which fluidly connects the recovery manifold 112 to the high-side and low-side lines 140, 144. The recovery manifold 112 includes components, for example a compressor, oil separators, a heat exchanger, and filters and dryer units, configured to remove oil entrained in refrigerant and purify the refrigerant when the refrigerant is recovered from an air conditioning circuit. The purified refrigerant is then stored in the ISV 14. The ISV charge line 156 connects the ISV 14 to the high-side and low-side lines 140, 144 through a charge solenoid valve 176 to enable recharging refrigerant from the ISV 14 to the air conditioning circuit.

A first oil receptacle 180, a second oil receptacle 184, and a dye receptacle 188 are fluidly connected to a first oil supply line 192, a second oil supply line 196, and a dye supply line 200, respectively. A first flow control valve 204 and a first oil injection solenoid valve 208 are fluidly connected to the first oil supply line 192, a second flow control valve 212 and a second oil injection solenoid valve 216 are fluidly connected to the second oil supply line 196, and a dye injection flow control valve 220 and a dye injection solenoid valve 224 are fluidly connected to the dye supply line 200 between the respective receptacle 180, 184, 188 and the high-side line 140. The solenoid valves 208, 216, 224 are fluidly connected to the high-side line 140 via a first oil injection line 226, a second oil injection line 228, and a dye injection line 230, respectively. In some embodiments, the solenoid valves 208, 216, 224 are directly connected to the high-side line 140 such that the high-side line 140 is the oil injection line.

Each of the first and second oil receptacles 180, 184 is configured to store a type of oil. In some embodiments, the oil stored in the first oil receptacle 180 has a different viscosity and different thermal properties than the oil stored in the second oil receptacle 184 to enable use of the ACS system 10 with a wider variety of air conditioning systems. The dye receptacle 188 stores dye, which can be injected into the air conditioning system to aid a user in diagnostic operations, for example locating a leak in the air conditioning system. In some embodiments, one or both of the oil receptacles 180, 184 are connected to the recovery manifold 112 by a system oil return line to transfer oil separated from recovered refrigerant back into the oil receptacle 180, 184 for subsequent reuse.

The flow control valves 204, 212, 220 and solenoid valves 208, 216, 224 are all disposed in the bulkhead manifold 104 in the embodiment of FIG. 3, though in other embodiments the valves 204, 208, 212, 216, 220, 224 may be in another manifold or installed individually within the ACS machine 10. In the embodiment of FIG. 3, the ACS machine 10 includes two oil receptacles 180, 184 and one dye bottle 188. In some embodiments, the ACS machine includes only one oil receptacle or more than two oil receptacles. In other embodiments, the ACS machine does not include a dye receptacle or the associated valves and lines, or the ACS machine may include more than one dye bottle to store different types of dye.

Figure 4:
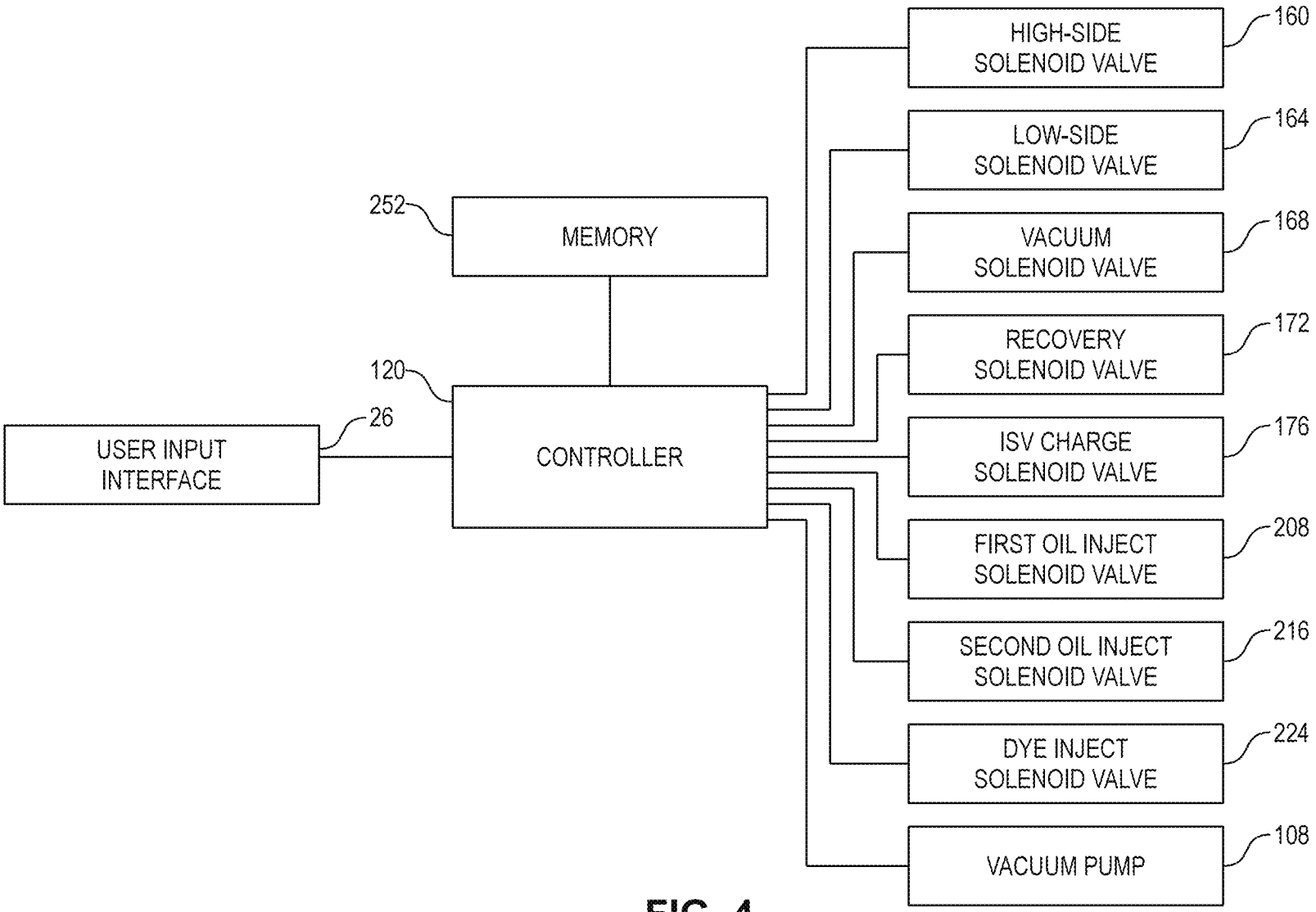
FIG. 4 is a schematic view of the control components of the refrigerant service system of FIG. 1.

FIG. 4 illustrates a schematic diagram of a control system 236 for the ACS machine 10. The control system 236 includes the controller 120, which is operably connected to a user input interface 26. The controller 120 is configured to receive inputs from the user input interface 26, and, in some embodiments, display information for a user on the user input interface 26.

The controller 120 is operably connected to a memory 252 to store data received from the user input interface 26. In one embodiment, the controller 120 and the memory 252 are integrated in the control module 20 of the ACS system 10. In other embodiments, the data is stored outside the ACS machine 10 and is transmitted via a wired or wireless internet connection to a "cloud" storage location. In another embodiment, the data is transmitted to a memory device such as a hard disk drive, a USB drive, a solid state drive, a network attached storage (NAS) device, or the like. The controller 120 is also operably connected to the solenoid valves 160, 164, 168, 172, 176, 208, 216, 224 and to the vacuum pump 108. The controller 120 is configured to transmit electronic signals to operate the solenoid valves 160, 164, 168, 172, 176, 208, 216, 224 to open and close and to operate the vacuum pump 108 to activate and deactivate.

Operation and control of the various components and functions of the ACS machine 10 are performed with the aid of the controller 120. The controller 120 is implemented with general or specialized programmable processors that execute programmed instructions. The instructions and data required to perform the programmed functions are stored in the memory unit 252 associated with the controller 120, in a memory unit integrated in the controller 120, or in a separately provided memory unit. The processors, memory, and interface circuitry configure the controller 120 to perform the functions described above and the processes described below. In one embodiment, these components are provided on a printed circuit card, while in other embodiments the components are provided as a circuit in an application specific integrated circuit (ASIC). In one embodiment, each of the circuits is implemented with a separate processor, while in other embodiments multiple circuits are implemented on the same processor or the circuits are implemented with discrete components or circuits provided in VLSI circuits. In some embodiments, the circuits described herein are implemented with a combination of processors, ASICs, discrete components, or VLSI circuits.

In operation, the high-side and low-side couplers 38, 40 of the service hoses 34, 36 are connected to the high-side and low-side connection ports of an air conditioning circuit, for example the air conditioning system of vehicle 50 of FIG. 2. To perform a recovery operation, the recovery solenoid 172 and one or both of the high-side and low-side solenoids 160, 164 are opened. Compressed refrigerant within the air conditioning circuit flows to the recovery manifold 112, where system oil entrained in the refrigerant is separated from the refrigerant and the refrigerant is purified for storage in the ISV 14.

As noted above, it is often necessary during normal maintenance of an air conditioning circuit to replace the system oil entrained in the refrigerant removed from the air conditioning system so that the air conditioning system continues to perform optimally. As such, an oil injection operation is performed after the refrigerant recovery operation, during which the refrigerant is recovered from the air conditioning circuit, and prior to a refrigerant recharge operation, during which refrigerant is recharged into the air conditioning circuit.

To this end, once the recovery operation is complete, the recovery solenoid 172 is closed, the vacuum solenoid 168 is opened, and the vacuum pump 108 is activated. The vacuum pump 108 produces a negative pressure in the high-side and low-side lines 140, 144, pulling any remaining refrigerant from the air conditioning circuit and reducing the pressure in the air conditioning circuit below atmospheric pressure. The high-side and low-side solenoid valves 160, 164 are then closed and the vacuum pump 108 is deactivated to close off the air conditioning system and retain the air conditioning system at the vacuum pressure.

The controller 120 then controls one of the oil injection solenoids 208, 216 to open. In some embodiments, the controller 120 is programmed to automatically select the appropriate solenoid valve 208, 216 to open based upon instructions stored in the memory 252. In other embodiments, a user instructs the controller 120 which oil injection solenoid valve 208, 216 to open via the user input interface 26, an external electronic device operably connected to the controller 120, or a combination thereof. Opening one of the oil injection solenoids 208, 216 results in the associated flow control valve 204, 212 opening due to the negative pressure in the air conditioning circuit and the high-side line 140. The corresponding oil receptacle 180, 184 is then fluidly connected to the air conditioning circuit of the vehicle through the oil supply line 192, 196, the flow control valve 204, 212, the solenoid valve 208, 216, the oil injection line 226, 228, and the high-side line 140. In the illustrated embodiment, the flow control valves 204, 212 are shown positioned between the respective solenoid valve 208, 216 and the oil receptacle 180, 184. In other embodiments, the solenoid valve 208, 216 may be positioned between the flow control valve 204, 212 and the oil receptacle 180, 184.

The flow control valve 204, 212 is configured such that the oil passes through the flow control valve 204, 212 at a predetermined flow rate, regardless of the temperature and viscosity of the oil. The controller 120 is configured to calculate the length of time the respective solenoid valve 208, 216 is to be open based on the amount of oil desired to be injected into the air conditioning circuit and the predetermined flow rate through the flow control valve 204, 212. The controller then controls the respective oil injection solenoid valve 208, 216 to open for the calculated length of time to inject the desired amount of oil through the associated flow control valve 204, 212 and the high-side line 140 into the air conditioning system.

Once the oil has been injected into the high-side line 140, the controller 120 operates to close the respective oil injection solenoid valve 208, 216 and performs a recharge operation. During the recharge operation, the charge solenoid valve 176 and the high-side solenoid valve 160 are opened. Refrigerant in the ISV 14 flows from the ISV through the high-side line 140 into the air conditioning circuit. Any residual oil remaining in the high-side line 140 from the oil injection operation is entrained in the refrigerant and transferred to the air conditioning circuit. In some embodiments, the low-side solenoid valve 164 is also opened during the recharge operation such that refrigerant flows from the ISV 14 through both the high and low side lines 140, 144 into the air conditioning circuit.

Figure 5:
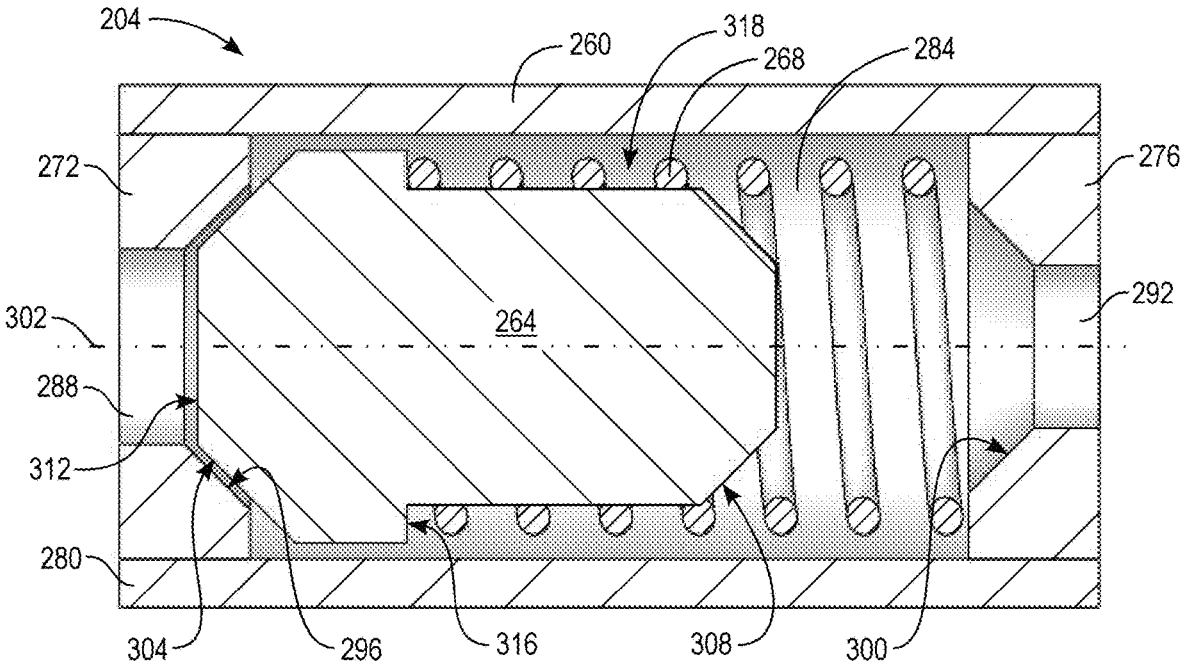
FIG. 5 is cross-sectional view of the flow control valve of the refrigerant service system of FIG. 1.

The flow control valve 204 is illustrated in more detail in FIG. 5. The flow control valve 204 includes a valve housing 260, a plunger 264, and an elastic biasing element, which in the embodiment of FIG. 5 is a helical compression spring 268. In other embodiments, however other types of biasing elements 268 can be used, for example a plate spring, torsion spring, or a pressurized fluid chamber. The valve housing 260 is cylindrical in the illustrated embodiment, though in other embodiments the housing may be square, rectangular, hexagonal, octagonal, or have another shape. The housing 260 includes two end walls 272, 276 and an outer circumferential wall 280 defining an inner chamber 284, in which the plunger 264 and spring 268 are positioned.

The first end wall 272 defines an inlet 288 fluidly connected to the first oil receptacle 180 via the first oil supply line 192, and the second end wall 276 defines an outlet 292 fluidly connected to the high-side line 140 through the first oil injection line 226 and the first oil injection solenoid valve 208. The first end wall 272 also includes a frustoconical inlet valve seat 296 between the inlet 288 and the chamber 284. The second end wall 276 includes a frustoconical outlet valve surface 300 between the chamber 284 and the outlet 292. The central axis of the inlet 288, the chamber 284, and the outlet 292 define a flow axis 302 of the fluid flowing through the valve 204.

Figure 6:
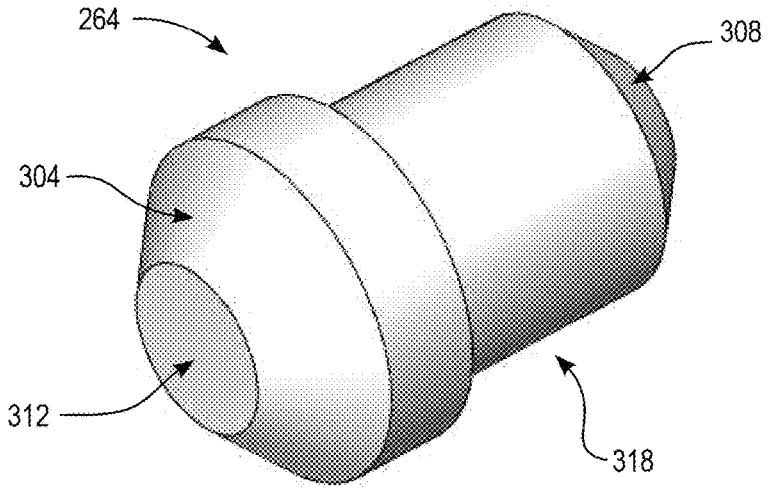
FIG. 6 is a perspective view of the plunger of the flow control valve of FIG. 5.
Figure 9:
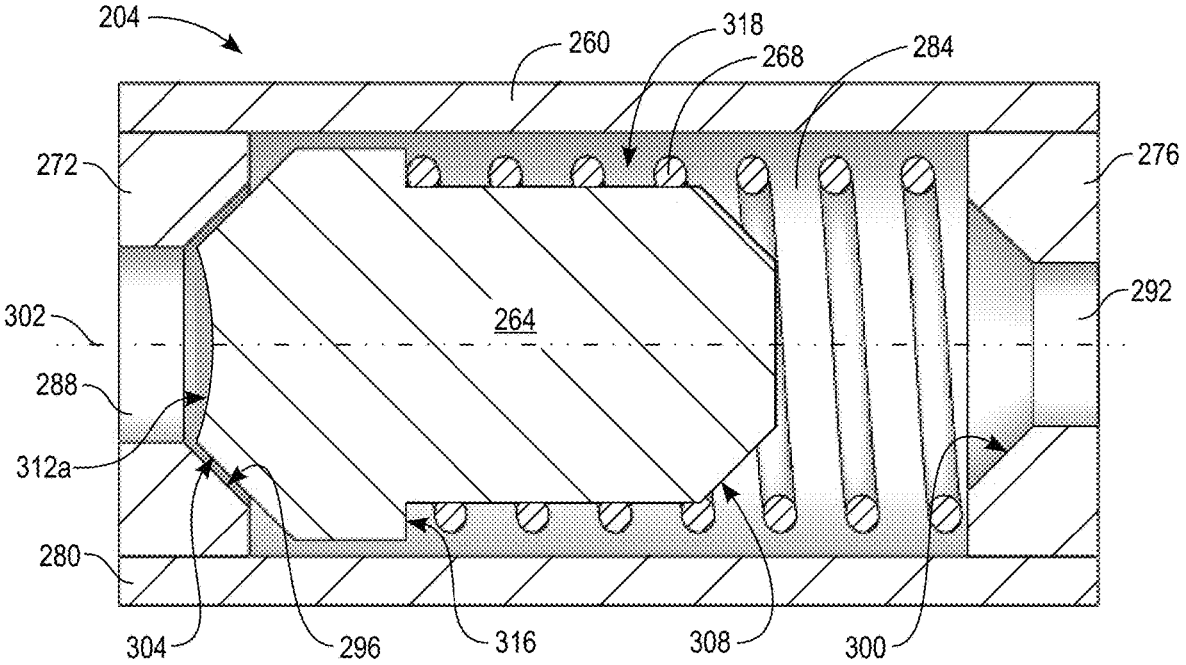
FIG. 9 is a cross-sectional view of the flow control valve in which the portion of the plunger facing the inlet has a concave shape, illustrated schematically and not to scale.

With reference to FIG. 6 and continuing reference to FIG. 5, the plunger 264 has an inlet side frustoconical surface 304 at a first end that is complementary to the inflow valve seat 296 and an outflow side frustoconical surface 308 at a second end that is generally complementary to the frustoconical surface 300 of the second end wall 276. An inlet facing surface 312 has a flat circular surface having essentially the same cross-section as the inlet 288. The reader should appreciate that, while the plunger 264 of the illustrated embodiment has a flat circular surface facing the inlet 288, the portion of the plunger 264 facing the inlet 288 may be shaped differently depending on the desired flow properties from the inlet 288 into the chamber 284. For example, in different embodiments, the portion of the plunger 264 facing the inlet 288 has a square surface, a conical shape, a hemispherical shape, a pyramidal shape, a convex shape, a concave shape (illustrated for example by the concave inflow surface 312*a* in FIG. 9), or any combination of the above-described surfaces or features. The plunger 264 also includes an annular ledge 316 facing towards the outlet 292 and a spring guide portion 318 between the annular ledge 316 and the outlet side frustoconical surface 308.

The spring 268 is braced at a first end against the annular ledge 316 of the plunger 264, and at an opposite end on the second end wall 276. The spring 268 has a diameter that is substantially equal to the spring guide portion 318 of the plunger 264 such that the spring 268 wraps around the spring guide portion 318 of the plunger 264. The spring 268 is configured to exert a biasing force on the plunger to bias the plunger to the left in the view of FIG. 5, toward the inlet side valve seat 296.

Figure 7:
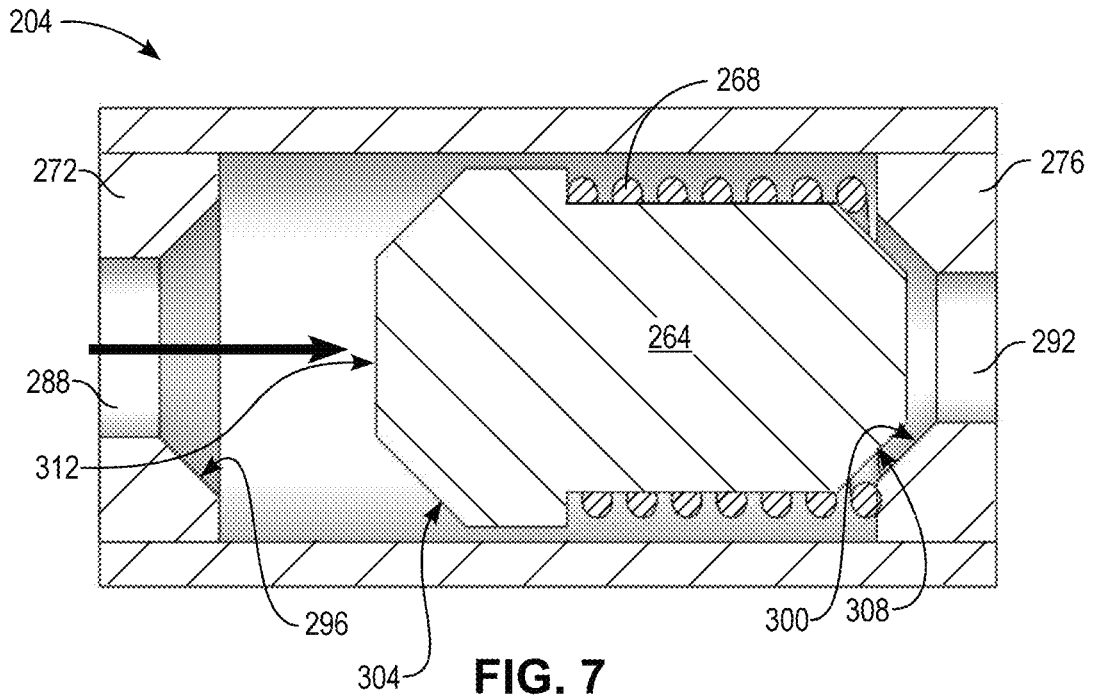
FIG. 7 is cross-sectional view of the flow control valve of FIG. 5 with a high velocity inflow.
Figure 8:
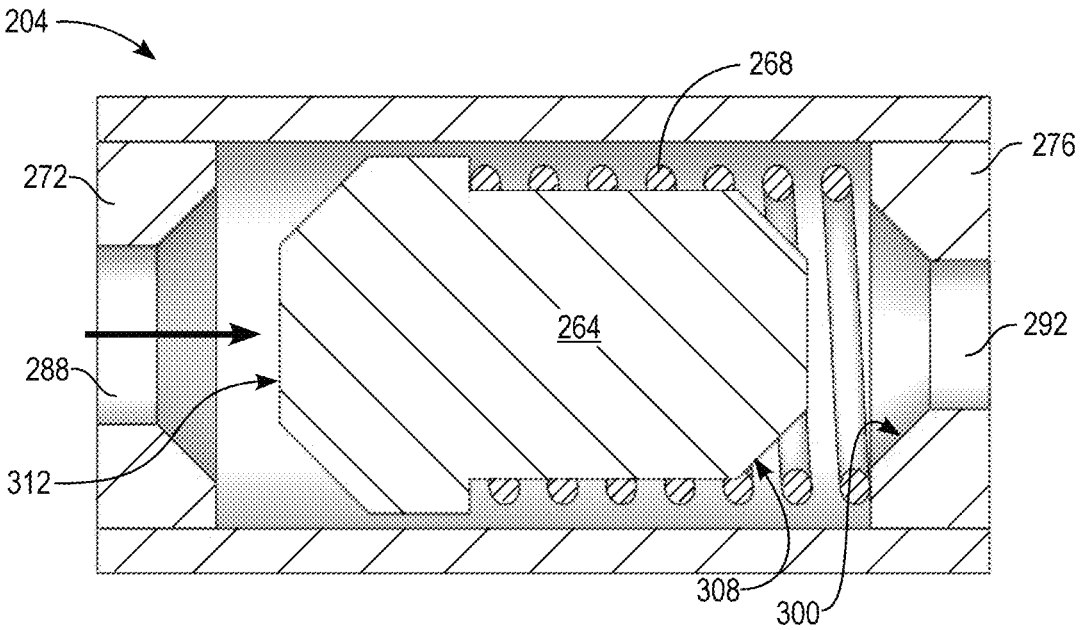
FIG. 8 is cross-sectional view of the flow control valve of FIG. 5 with a low velocity inflow.

Operation of the flow control valve 204 is illustrated in FIGS. 5, 7, and 8. In the default state, which occurs in the absence of a pressure difference between the inlet side and outlet side, the plunger 264 is urged by the spring 268 to the left in the view of FIG. 5 such that the inflow side frustoconical surface 304 of the plunger 264 seals against the inflow valve seat 296. The flow control valve 204 thus prevents reverse flow from the outlet 292 to the inlet 288, thereby functioning as a check valve. In some embodiments, however, the plunger 264 does not seal against the inflow valve seat 296.

Upon opening of the first oil injection solenoid valve 208, the vacuum pressure in the high-side line 140 (FIG. 3) reduces the pressure acting on the outlet end side of the plunger 264. When the pressure on the inlet side of the plunger 264 is greater than the sum of the force exerted by the spring 268 and the outlet side pressure, the inlet side pressure urges the plunger 264 toward the outlet 292, opening a gap between the inlet side frustoconical surface 304 and the inlet valve seat 296. The pressure difference between the pressure at the inlet 288 and the outlet 292 pushes oil from the oil receptacle 180 through the first oil supply line 192 and into the inlet 288 of the flow control valve 204. As the oil enters the valve 204, it contacts the inlet facing surface 312 of the plunger 264.

Newton's Second Law states that force (F) is equal to mass (m) times acceleration (a), and acceleration is the time derivative of velocity (a=dv/dt), which can also be conceived of as the change in velocity per unit time. Thus, the force exerted by a fluid decelerating as it strikes the inflow surface 312 is equal to m(dv/dt), or d(mv)/dt.

The force initially exerted on the plunger 264 by the oil flowing into the valve, i.e. the force due to the deceleration of the oil as it strikes, or impinges on, the inflow surface 312 (d(mv)/dt), will initially be greater than the force exerted on the plunger 264 by the spring 268. As the spring 268 compresses, the force it exerts on the plunger 264 increases, reducing the acceleration of the plunger 264. When the spring 268 has compressed such that the spring 268 exerts the same force as the oil striking the inlet facing surface 312, the plunger 264 will stop moving.

Since the force exerted by the oil is proportional to the deceleration of the oil striking the inlet facing surface 312, the force is also proportional to the velocity of the oil entering the valve 204. Oil having a higher viscosity flows slower, and thus has a lower velocity. The high viscosity oil will therefore strike the inlet facing surface 312 with a lesser force than lower viscosity oil. As such, oil having a lower viscosity pushes the plunger 264 further toward the outlet 292 against the force of the spring 268 compared to the high viscosity oil. As the plunger 264 is urged further toward the outlet side frustoconical surface 300, the outlet side of the plunger reduces the area through which oil flows. This constriction reduces the flow through the valve 204.

At a given pressure difference between the inlet 288 and the outlet 292, the flow rate of the oil through the flow control valve 204 is a function of the velocity of the fluid flowing, the cross-sectional area through which the fluid is flowing, and the spring force exerted by the spring 218 on the plunger 264, which is a function of the spring constant.

In order to tune the valve 204, the maximum flow rate through the valve 204 is set for the oil of the highest viscosity that is to be used in the valve 204. The geometry of the frustoconical surfaces 300, 308, the area and geometry of the inlet facing surface 312, and the spring constant of the spring 268 are further tuned for oils of various viscosities such that the flow rate through the valve is independent of the viscosity of the oil flowing through the valve 204.

FIG. 7 illustrates the valve 204 in operation with low-viscosity oil having a high inflow velocity. The velocity of the oil entering the valve 204 in the illustration of FIG. 7 is great enough that the plunger 264 moves to a position at which the distance between the outflow side frustoconical surface 308 of the plunger 264 and the frustoconical surface 300 of the end wall 276 is small. The limited distance between the outflow side frustoconical surface 308 and the frustoconical surface 300 of the end wall 276 constricts the flow of oil, and the flow rate of the oil exiting the valve 204 is therefore reduced as compared to unconstructed flow.

Conversely, FIG. 8 illustrates the valve 204 operating with higher viscosity oil entering the valve 204. The high-viscosity oil enters the valve 204 with a lesser velocity, resulting in the oil impinging on the inlet facing surface 312 with a lower velocity, and therefore urging the plunger 264 against the force of the spring 268 a lesser distance towards the outlet 292. In this instance, there is no constriction between the outflow side frustoconical surface 308 and the frustoconical surface 300 of the end wall 276, and the outflow is therefore not restricted by the outflow side of the plunger 264.

Since the viscosity is dependent primarily on the type and temperature of the oil, the flow control valve 204 enables constant flow through the valve independent of the type or temperature of the oil. Moreover, since the flow rate through the flow control valve 204 is constant, the quantity of oil injected into the air conditioning system per unit time is known. The desired quantity of oil can therefore be injected into the air conditioning circuit accurately by determining the duration to open the solenoid valve 208 based upon the flow rate, and then opening the oil injection solenoid valve 208 for this determined duration.

The reader should appreciate that the above-described oil injection system is not limited to use with the described flow control valve. In other embodiments, for example, the flow control valve modulates the flow through the valve as a function of the ambient temperature, which directly affects the viscosity of the oil. Such a valve may include a temperature sensing material, for example a bulb of refrigerant, that expands or contracts to control the amount of oil passing through the valve.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

The invention claimed is:

1. An air conditioning service system, comprising:

an oil receptacle configured to store an oil;

a solenoid valve configured to selectively allow the oil to flow from the oil receptacle into an oil injection line;

a coupling port in fluid communication with the oil receptacle through the oil injection line when the solenoid valve is in an open condition; and a flow control valve including a chamber with an inlet and an outlet, the inlet in fluid communication with the oil receptacle when the solenoid valve is in the open condition, and the outlet in fluid communication with the oil injection line when the solenoid valve is in the open condition, wherein the flow control valve is configured such that, for a given pressure difference between the inlet and the outlet, the oil flows from through the flow control valve at a flow rate that is independent of a viscosity of the oil within a predetermined range of viscosities.

2. The air conditioning service system of claim 1, wherein the flow control valve further comprises:

a plunger movably positioned within the chamber, the plunger having an inlet facing surface at a first end portion configured to be impinged by the oil and a second end portion opposite the first end portion configured to increasingly restrict flow of the oil through the outlet as the plunger moves toward the outlet; and a biasing member configured to bias the plunger in a direction toward the inlet, wherein the biasing member and plunger are configured such that for the given pressure difference between the inlet and the outlet, the oil flows from through the flow control valve at the flow rate that is independent of the viscosity of the oil.

3. The air conditioning service system of claim 2, wherein the inlet facing surface is perpendicular to a flow axis of the oil entering the inlet.

4. The air conditioning service system of claim 3, further comprising:

an outlet valve seat associated with the outlet, wherein the second end portion includes a second end portion valve portion complementary to the outlet valve seat.

5. The air conditioning service system of claim 4, further comprising:

an inlet valve seat associated with the inlet, wherein the first end portion includes a first end portion valve portion complementary to the inlet valve seat.

6. The air conditioning service system of claim 5, wherein the first end portion valve portion extends about the inlet facing surface.

7. The air conditioning service system of claim 2, further comprising an inlet valve seat associated with the inlet, wherein:

the first end portion includes a first end portion valve portion complementary to the inlet valve seat; and the first end portion valve portion extends about the inlet facing surface.

8. The air conditioning service system of claim 7, wherein the inlet facing surface is planar and perpendicular to a flow axis of the oil entering the inlet.

9. The air conditioning service system of claim 8, wherein:

the inlet defines an inlet cross sectional area;

the inlet facing surface defines an inlet facing surface area; and the inlet cross sectional area is equal to the inlet facing surface area.

10. The air conditioning service system of claim 7, wherein the inlet facing surface is concave.

11. A flow control valve for use in an air conditioning service system, the flow control valve comprising:

a chamber with an inlet and an outlet;

a plunger movably positioned within the chamber, the plunger having an inlet facing surface at a first end portion and a second end portion opposite the first end portion; and a biasing member configured to bias the plunger toward the inlet, wherein the inlet facing surface, the second end portion, and the biasing member are configured such that a flow rate of air conditioning oil through the flow control valve remains constant over a predetermined range of viscosities of the air conditioning oil for a given differential pressure across the flow control valve.

12. The flow control valve of claim 11, wherein the inlet facing surface is perpendicular to a flow axis of the air conditioning oil entering the inlet.

13. The flow control valve of claim 12, further comprising:

an outlet valve seat associated with the outlet, wherein the second end portion includes a second end portion valve portion complementary to the outlet valve seat.

14. The flow control valve of claim 13, further comprising:

an inlet valve seat associated with the inlet, wherein the first end portion includes a first end portion valve portion complementary to the inlet valve seat.

15. The flow control valve of claim 14, wherein the first end portion valve portion extends about the inlet facing surface.

16. The flow control valve of claim 11, further comprising an inlet valve seat associated with the inlet, wherein:

the first end portion includes a first end portion valve portion complementary to the inlet valve seat; and the first end portion valve portion extends about the inlet facing surface.

17. The flow control valve of claim 16, wherein the inlet facing surface is planar and perpendicular to a flow axis of the oil entering the inlet.

18. The flow control valve of claim 17, wherein:

the inlet defines an inlet cross sectional area;

the inlet facing surface defines an inlet facing surface area; and the inlet cross sectional area is equal to the inlet facing surface area.

19. The flow control valve of claim 16, wherein the inlet facing surface is concave.

* * * * *